US007329208B2

(12) United States Patent
Yeh

(10) Patent No.: US 7,329,208 B2
(45) **Date of Patent: *Feb. 12, 2008**

(54) DYNAMIC MAGNETIC HEALTH BED

(76) Inventor: Don Lon Yeh, 7Fl-3, 144, San Min Rd., Sec. 13, Taichung (TW) 40445

( * ) Notice: Subject to any disclaimer, the term of this patent is extended or adjusted under 35 U.S.C. 154(b) by 180 days.

This patent is subject to a terminal disclaimer.

(21) Appl. No.: 11/129,353

(22) Filed: May 16, 2005

(65) Prior Publication Data

US 2005/0221959 A1 Oct. 6, 2005

(51) Int. Cl.
*A63B 22/02* (2006.01)
*A61H 1/00* (2006.01)
*A61H 7/00* (2006.01)

(52) U.S. Cl. ..... 482/54; 601/15; 601/144

(58) Field of Classification Search ..... 482/51, 482/54; 601/98, 15, 100, 101, 18, 124, 132, 601/144

See application file for complete search history.

(56) References Cited

U.S. PATENT DOCUMENTS 3,085,568 A * 4/1963 Whitesell ..... 601/55
4,760,655 A * 8/1988 Mauch ..... 36/44
4,947,833 A * 8/1990 Yamasaki ..... 601/102
5,103,513 A * 4/1992 King ..... 5/118
6,454,732 B1 * 9/2002 Lee ..... 601/101
6,849,054 B1 * 2/2005 Kim ..... 601/98
6,918,859 B1 * 7/2005 Yeh ..... 482/54
7,013,588 B2 * 3/2006 Chang ..... 36/141
7,118,541 B2 * 10/2006 Kim ..... 601/15
7,160,260 B2 * 1/2007 Hsiao ..... 601/49

* cited by examiner

*Primary Examiner*—Stephen R. Crow
(74) *Attorney, Agent, or Firm*—Bacon & Thomas, PLLC

(57) ABSTRACT

Provided is a dynamic magnetic health bed comprising a bed unit comprising holes on its upper surface and stone shaped permanent magnets fastened in the holes; and a drive assembly in a front end of the bed unit and comprising a motor, front and rear rolls driven by the motor, and an endless transfer belt driven by the rolls and covered on surfaces of the bed unit. Continuously conveying the transfer belt by activating the motor and changing motor speed with a predetermined frequency of changing rotating direction of the motor per unit time, a person lying on the bed unit vibrates, a magnetic field from the magnets to nerve of the vibrating person is cut by the nerve, a weak current flow is generated in the body by the magnetic induction, and the current is adapted to accelerate metabolism and blood circulation while the back is being massaged.

5 Claims, 9 Drawing Sheets

DYNAMIC MAGNETIC HEALTH BED

CROSS-REFERENCE TO RELATED APPLICATIONS

This application is a continuation-in-part application of U.S. Ser. No. 10/350,073, now U.S. Pat. No. 6,918,859, the teaching of which is hereby incorporated by reference.

BACKGROUND OF THE INVENTION

1. Field of Invention

The present invention relates to health beds and more particularly to a dynamic magnetic health bed with improved characteristics.

2. Related Art

Health beds, chairs, or the like are gaining popularity among people recently. Typically, one such device is powered by a motor for causing vibration effect and/or massage effect to a user. Moreover, magnetic field generation is introduced in many types of health products in recent years. A magnetic field can be generated by magnet (i.e., naturally present) or electromagnet (i.e., artificially induced). For the later, electromagnetic waves are generated and they are harmful to the health. Thus, it is not desired.

A conventional magnetic health bed has one or more stationary magnetic members. That is, no relative motion between the bed and a user lying thereon. Such does no good to blood circulation. Thus, stationary health bed is also not desired. Thus, continuing improvements in the exploitation of dynamic magnetic health bed are constantly being sought.

SUMMARY OF THE INVENTION

It is therefore an object of the present invention to provide a health bed comprising a bed unit comprising a plurality of holes on its upper surface and a plurality of stone shaped permanent magnets each fastened in the hole; and a drive assembly in a front end of the bed unit and comprising a motor, front and rear rolls driven by the motor, and an endless transfer belt rotatably driven by the rolls and covered on both surfaces of the bed unit; wherein in response to continuously conveying the transfer belt by activating the motor, in response to changing a rotating speed of the motor per unit time, and in response to a predetermined frequency of changing a rotating direction of the motor per unit time, a person lying on the bed unit vibrates, a magnetic field from the magnets to nerve of the vibrating person is cut by the nerve, and a weak current flow is generated in the body of the person by the magnetic induction. By utilizing the health bed, both metabolism and blood circulation are accelerated by the induced current while the back of the person is being massaged.

In one aspect of the present invention, the magnets each has a portion either projecting from a top surface of the bed unit or being flush with the top surface of the bed unit.

In another aspect of the present invention, in response to the magnets each having a portion projecting from the top surface of the bed unit, a person lying on the transfer belt is adapted to have the back being massaged by heat generated by friction between the conveying transfer belt and the magnets and conducted thereto.

In yet another aspect of the present invention, the bed unit further comprises two rear, lower toothed bars at both sides, and two rear folding rods each having an upper end pivotably connected to either side of the bed unit and a lower end adjustably connected to the toothed bar for adjusting height and obliqueness of the bed unit.

In a further aspect of the present invention, the bed unit further comprises a plurality of transverse support members and a plurality of separate sections, a front on of the sections having its rear end pivotably connected to a front one of the support members, a rear one of the sections having its front end pivotably connected to a rear one of the support members, and one or more intermediate ones of sections each having its front and rear ends pivotably connected to one of the remaining support members such that the rear section is adapted to pivot toward the front section for folding the bed unit, and wherein the bed unit further comprises two pivotal extension boards each extended along side from either end of the support member at the rear section, and two press rolls each at an open end of the extension board for pressing a folded portion of the transfer belt.

The above and other objects, features and advantages of the present invention will become apparent from the following detailed description taken with the accompanying drawings.

DETAILED DESCRIPTION OF THE INVENTION

Figure 1:
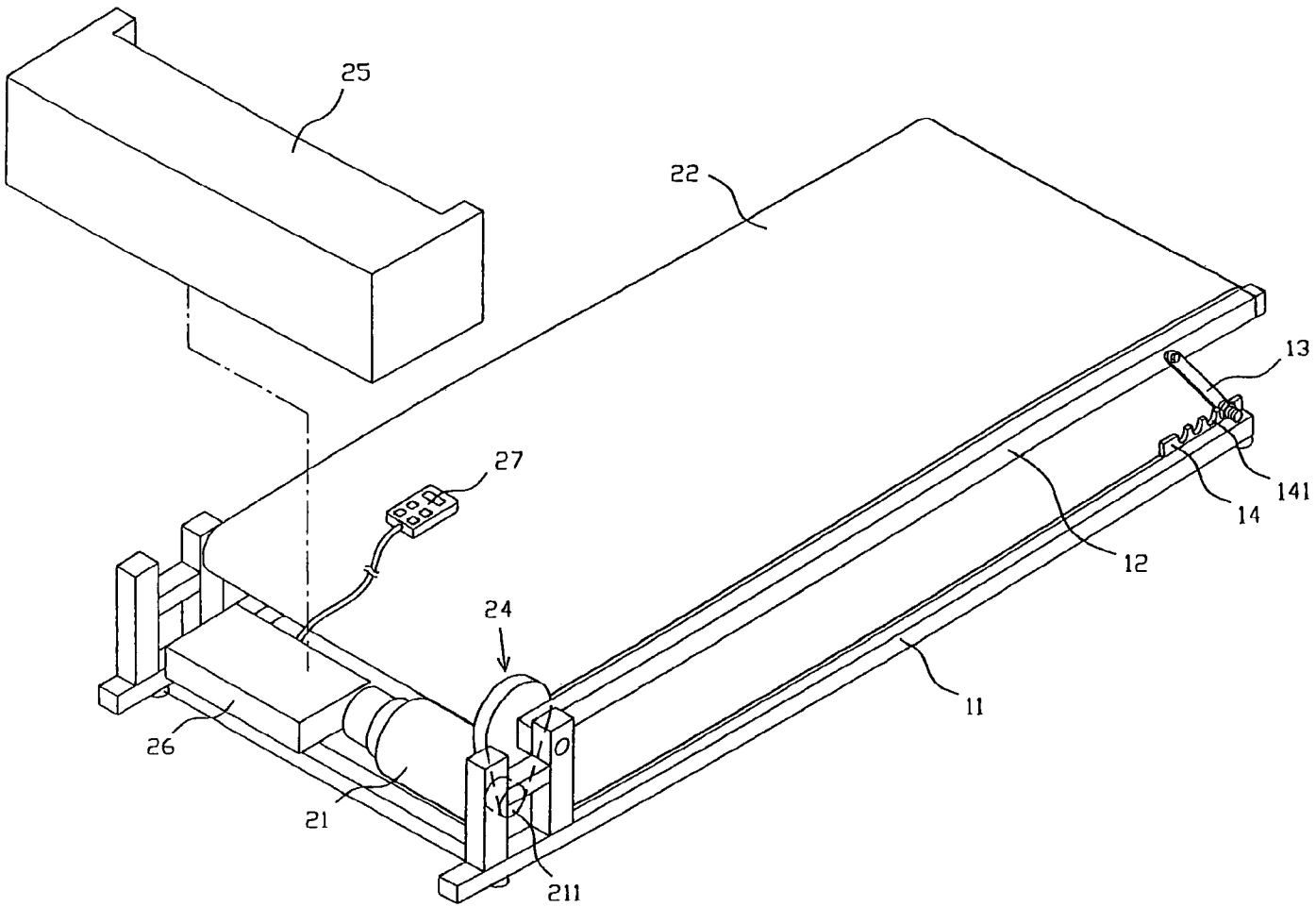
FIG. 1 is a perspective view of a first preferred embodiment of health bed according to the invention, where a hood is separate.
Figure 2:
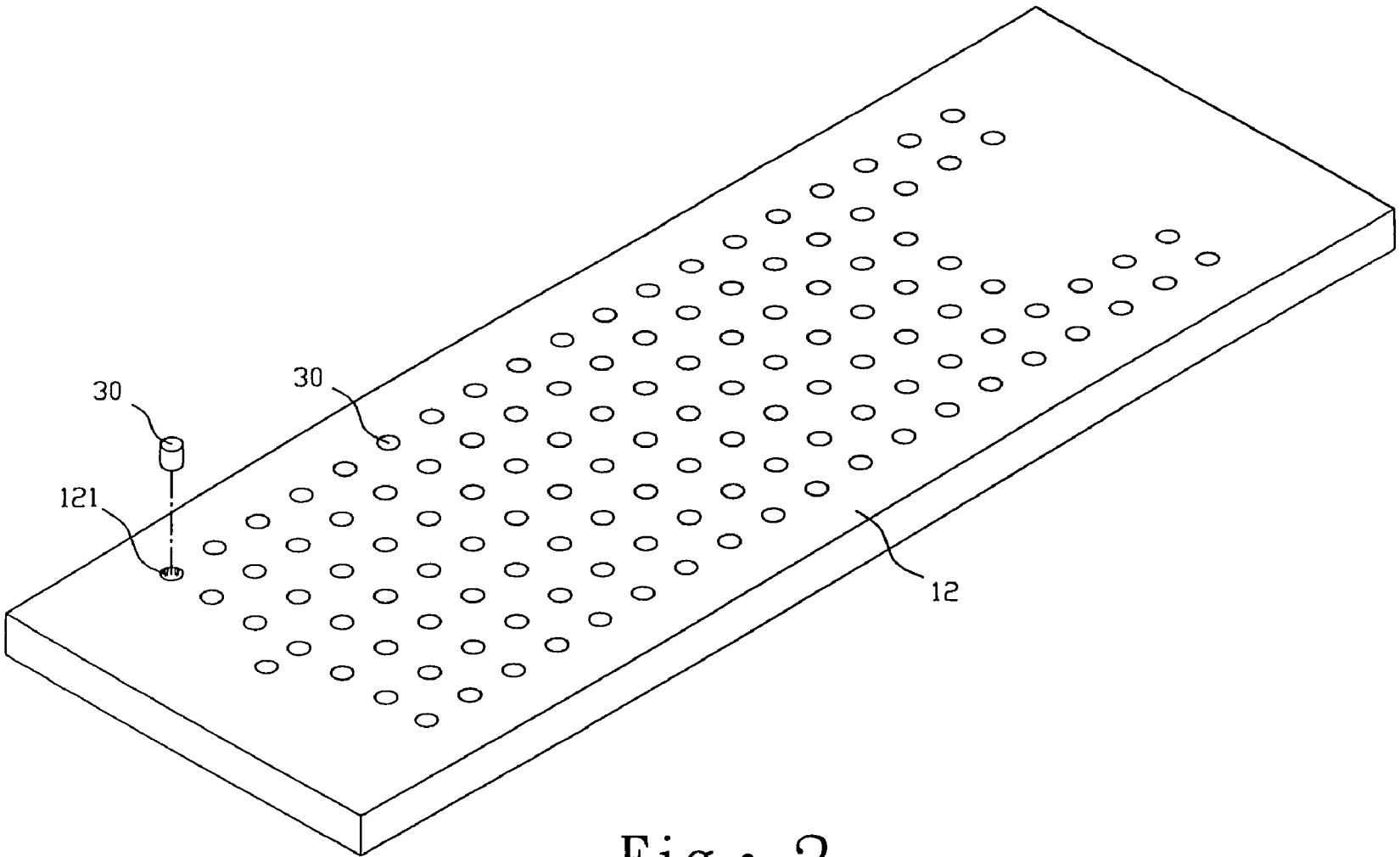
FIG. 2 is a perspective view of a bed unit.
Figure 3:
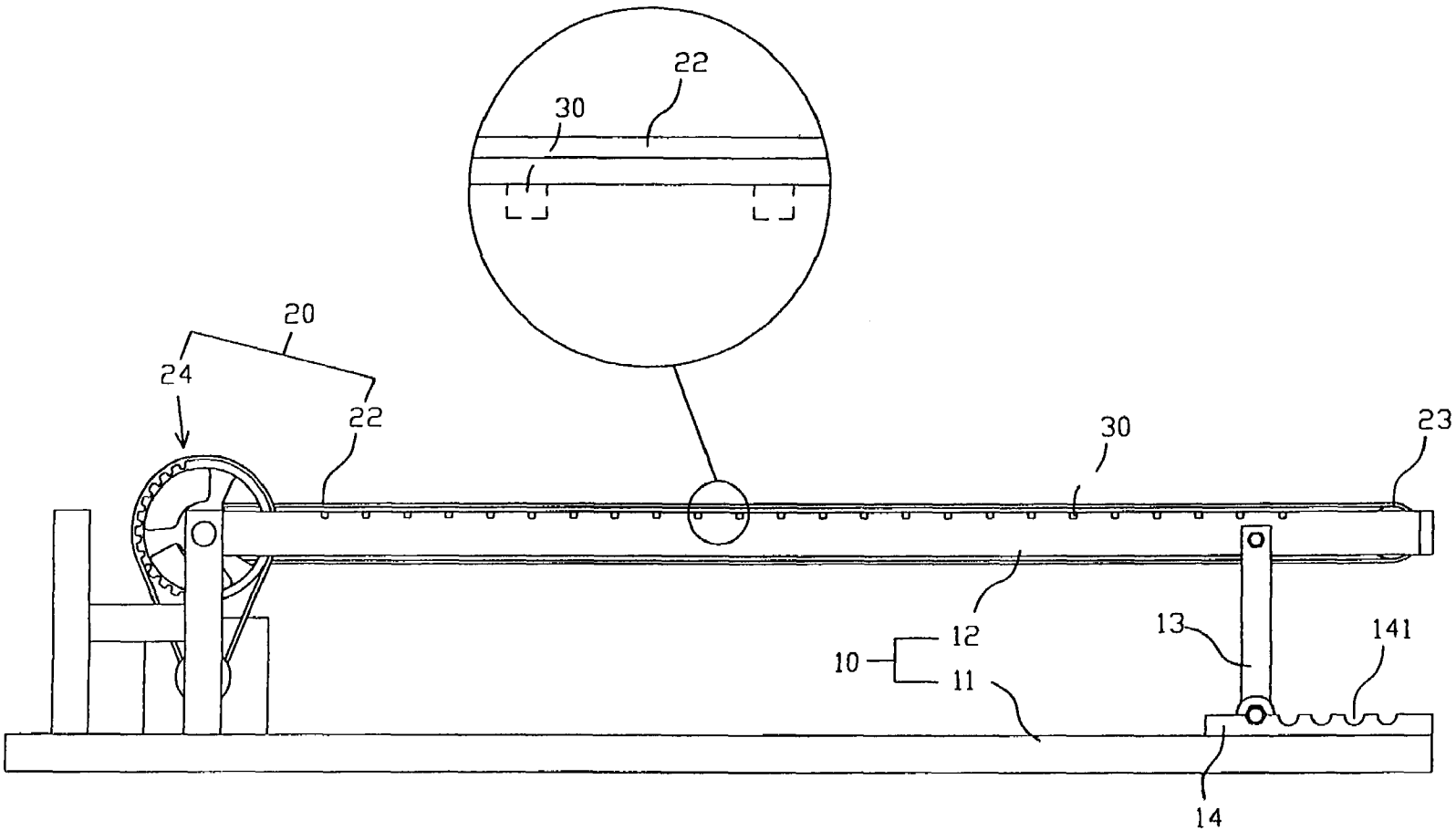
FIG. 3 is a side view of the bed in its first configuration, where magnets each has a portion being flush with the top surface of the bed unit.

Referring to FIGS. 1 to 5, a health bed constructed in accordance with a first preferred embodiment of the invention is shown. The bed comprises a bed assembly 10 and a drive assembly 20. Each component is discussed in detailed below.

The bed assembly 10 comprises a base 11, an upper bed unit 12 including a plurality of holes 121 arranged in rows, each hole 121 having a stone shaped permanent magnet 30 tightly fitted therein, two rear toothed bars 14 each having a plurality of teeth 141 at either side of the base 11, and two folding rods 13 each having an upper end pivotably connected to either side of the bed unit 12 and a lower end adjustably connected to the tooth of the toothed bar 14.

The drive assembly 20 is disposed in a front portion of the bed assembly 10 and comprises a hood 25 removably covered thereon, a motor 21 on the base 11, the motor 21 having a driving shaft 211 extended toward one side of the base 11, front and rear rollers 23, an endless transfer belt 22 driven by the rolls 23 and covered on both surfaces of the bed unit 12 in which in a first configuration the magnets 30 each has a portion being flush with the a top surface of the bed unit 12 (see FIG. 3) or in a second configuration the magnets 30 each has a portion projecting from the top surface of the bed unit 12 (see FIG. 4), a transmission belt 24 having one end (e.g., wheel) rotatably connected to the front roll 23 and the other end run around the driving shaft 211 such that motion of the driving shaft 211 can be transferred to the transfer belt 22 via the transmission belt 24 when the motor 21 is activated, a control box 26 on the base 11, and a wired controller 27 adapted to control rotating speed and rotating direction of the motor 21, and other associated devices via the control box 26.

Figure 4:
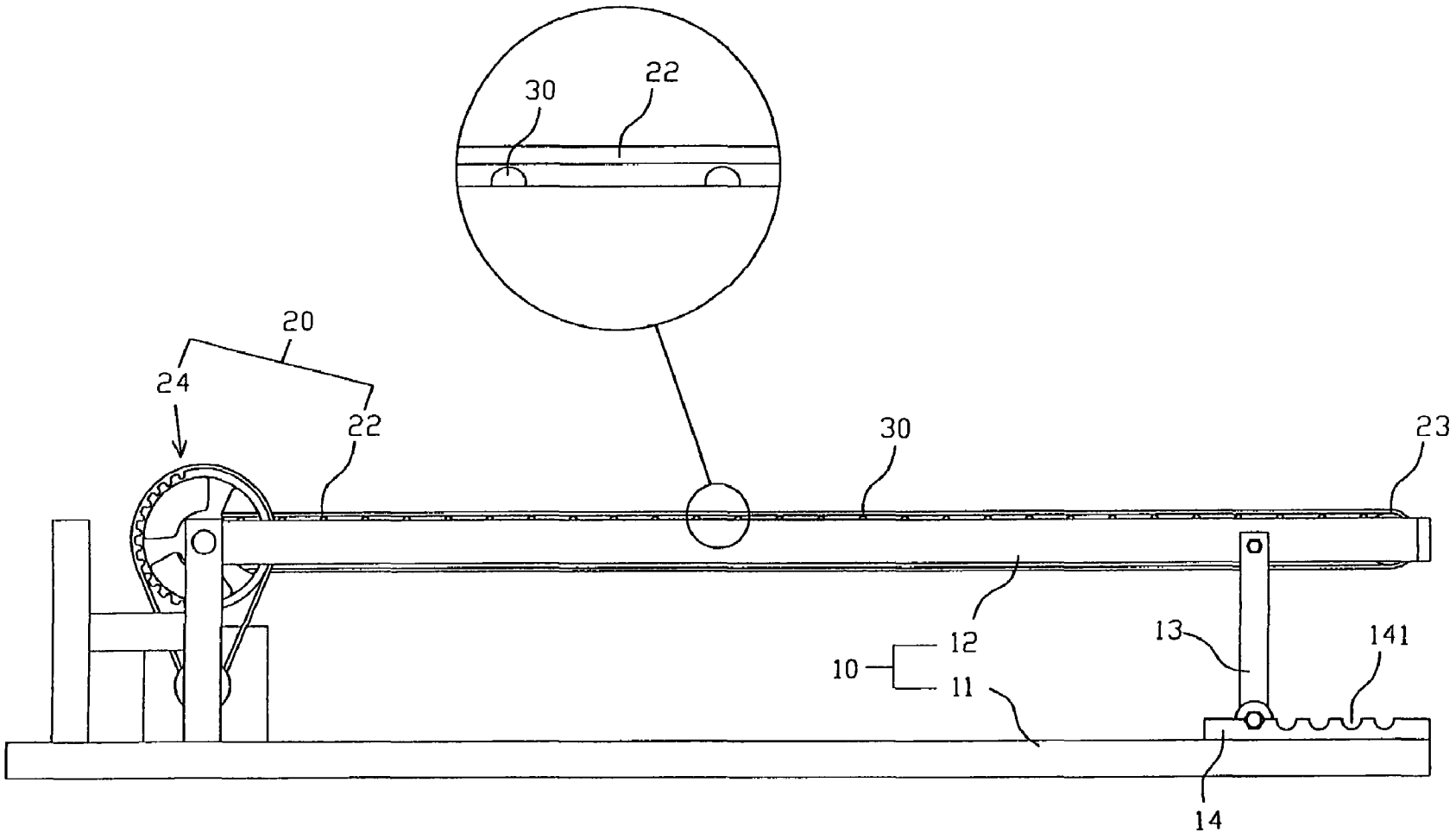
FIG. 4 is a side view of the bed in its second configuration, where magnets each has a portion projecting from a top surface of the bed unit.
Figure 5:
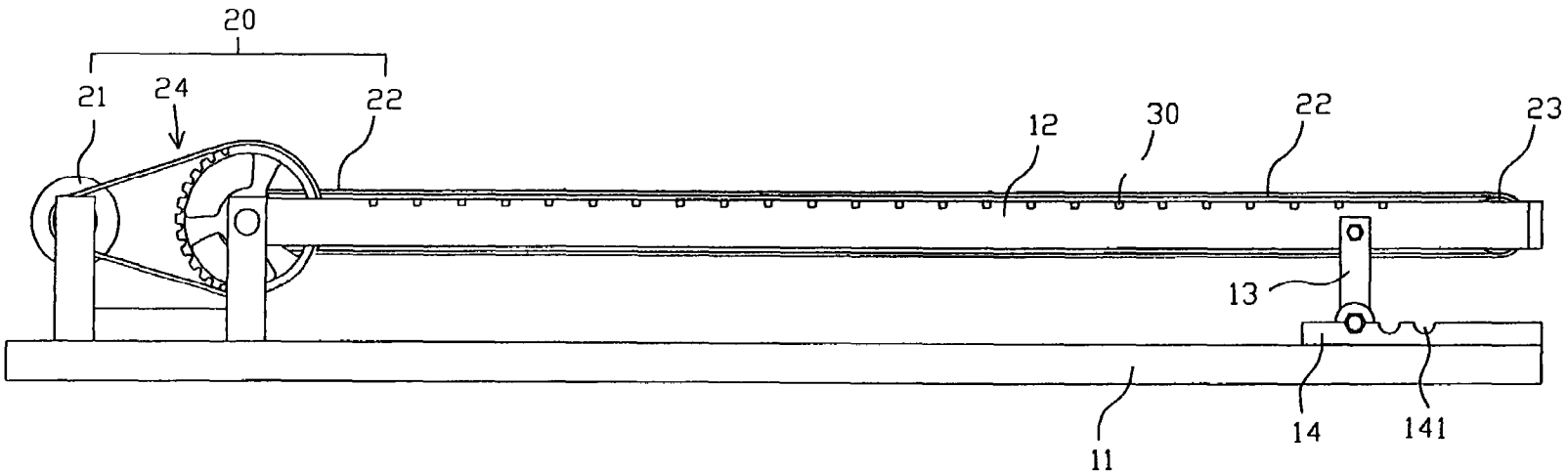
FIG. 5 is a side view of the bed where drive assembly is arranged in another configuration different from that shown in FIG. 3.

As shown in FIG. 4, the folding rods 13 are fully extended. As such, the bed unit 12 is disposed in a highest location relative to the base 11 and also the driving shaft 211 is disposed below the front roll 23. Alternatively, as shown in FIG. 5, the folding rods 13 are folded. As such, the bed unit 12 is disposed in a lowest location relative to the base 11 and also the driving shaft 211 is disposed ahead the front roll 23. In brief, the bed unit 12 has height and obliqueness adjustment capabilities.

Figure 9:
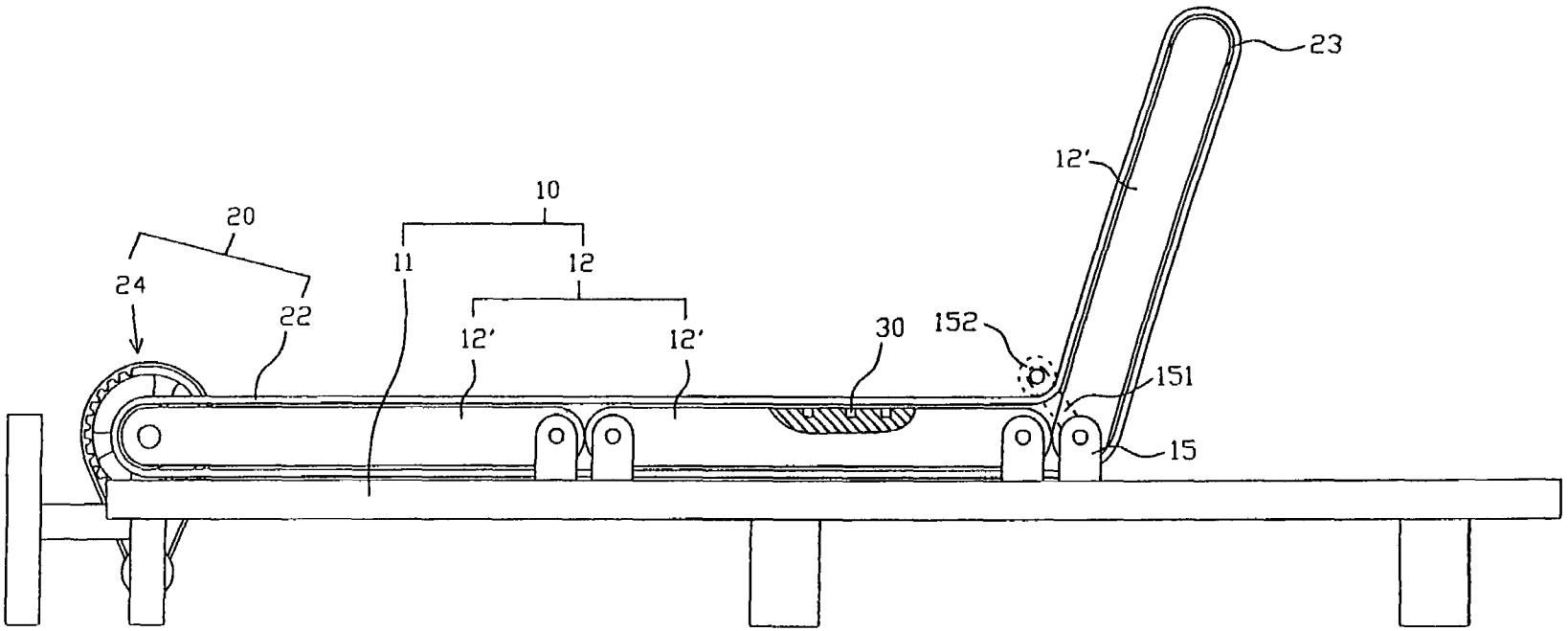
FIG. 9 is a side view schematically showing a second preferred embodiment of bed unit according to the invention.

Referring to FIG. 9, a second preferred embodiment of the bed unit 12 according to the invention is shown. The bed unit 12 comprises three separate sections 12' in which the front section 12' has its rear end pivotably connected to a transverse support member 15 on the base 111, the intermediate section 12' has its front and rear ends pivotably connected to two transverse support members 15 on the base 111, and the rear section 12' has its front end pivotably connected to a transverse support member 15 on the base 111. As such, the rear section 12' is adapted to pivot toward the front section 12' (i.e., the bed unit 12 is folded). Moreover, for preventing the transfer belt 22 from disengaging the bed unit 12 in the folding operation each of two pivotal extension boards 151 is extended along the side from either end of the support member 15 of the rear section 12'. Further, a roll 152 is provided at an open end of either extension board 151 for pressing on a joining position of a folded portion of the transfer belt 22 and a flat portion thereof. As such, the transfer belt 22 can maintain its correct configuration. Note that the provision of the extension boards 151 does not interfere with a person lying on the bed unit 12.

In a case of the transfer belt 22 conveyed by starting the motor 21, the body of a person lying on the bed unit 12 is moved back and forth, or vibrated, by the transfer belt 22. Also, a magnetic field from the magnets 30 is intersected by nerves of the person, the nerves acting as conductors such that a magnetic current is induced by the vibration. As a result, a weak current flow is generated in cells of the body by magnetic induction. The current is beneficial to both metabolism and the blood circulation while the back is being massaged. Moreover, the vibration continues when the transfer belt 22 conveys (i.e., massage effect). The strength of the vibration and the degree of accelerating both metabolism and blood circulation can be controlled by changing the vibration of the bed unit 12 by changing rotating speed of the motor 21 per unit time (i.e., the rotation speed changed from 1200 RPM to 3600 RPM and vice versa per minute) and a frequency of changing rotating direction of the motor 21 per unit time (i.e., clockwise rotation changed to counterclockwise rotation and vice versa three times per second).

Figure 6:
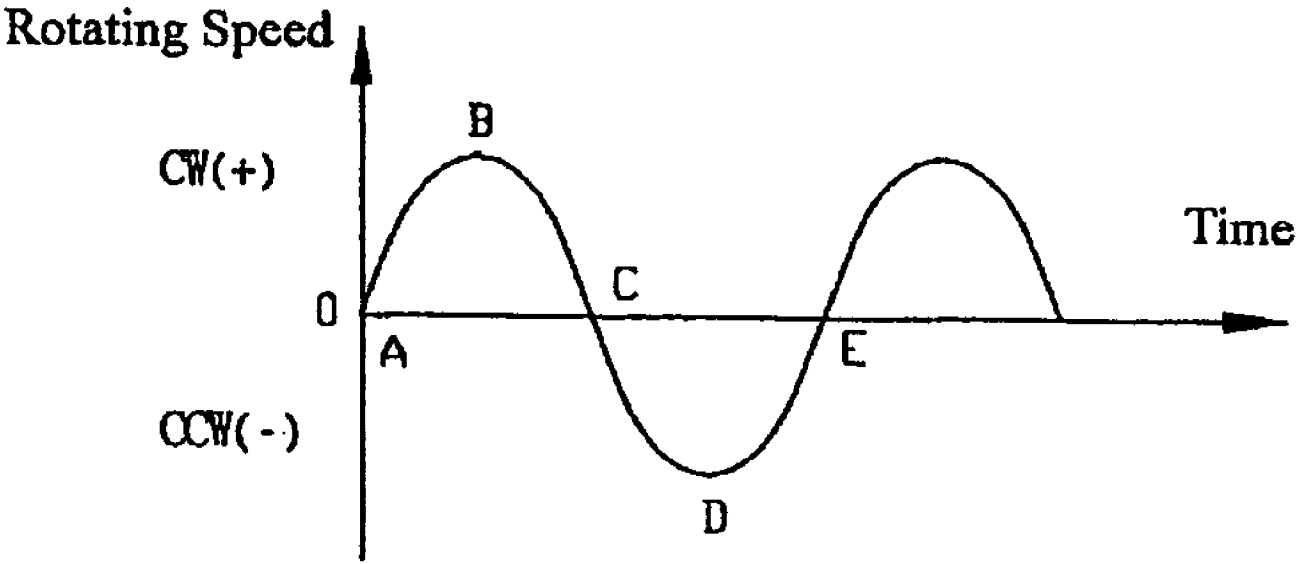
FIG. 6 plots rotating speed versus time for an activating motor of the drive assembly in its first operating mode.

Referring to FIG. 6, a first operating mode of the invention is illustrated. At time A the rotating speed of the motor 21 is zero. After starting, the clockwise rotating speed of the motor 21 increases and is plotted as a sinusoidal wave. At time B, the clockwise rotating speed of the motor 21 is a maximum. After time B, the clockwise rotating speed of the motor 21 begins to decrease. At time C, the clockwise rotating speed of the motor 21 is zero again. After time C, the counterclockwise rotating speed of the motor 21 increases. At time D, the counterclockwise rotating speed of the motor 21 is a maximum. After time D, the counterclockwise rotating speed of the motor 21 begins to decrease. At time E (i.e., time A again), the counterclockwise rotating speed of the motor 21 is zero again. The above period will continue as the motor 21 rotates. Also, the transfer belt 22 conveys back and forth cyclically with varying speed. As a result, the effects of accelerating blood circulation and massage are obtained. It is understood that the above effects can be enhanced by strong vibration of the bed unit 12, i.e., the motor 21 operates in high power mode.

Figure 7:
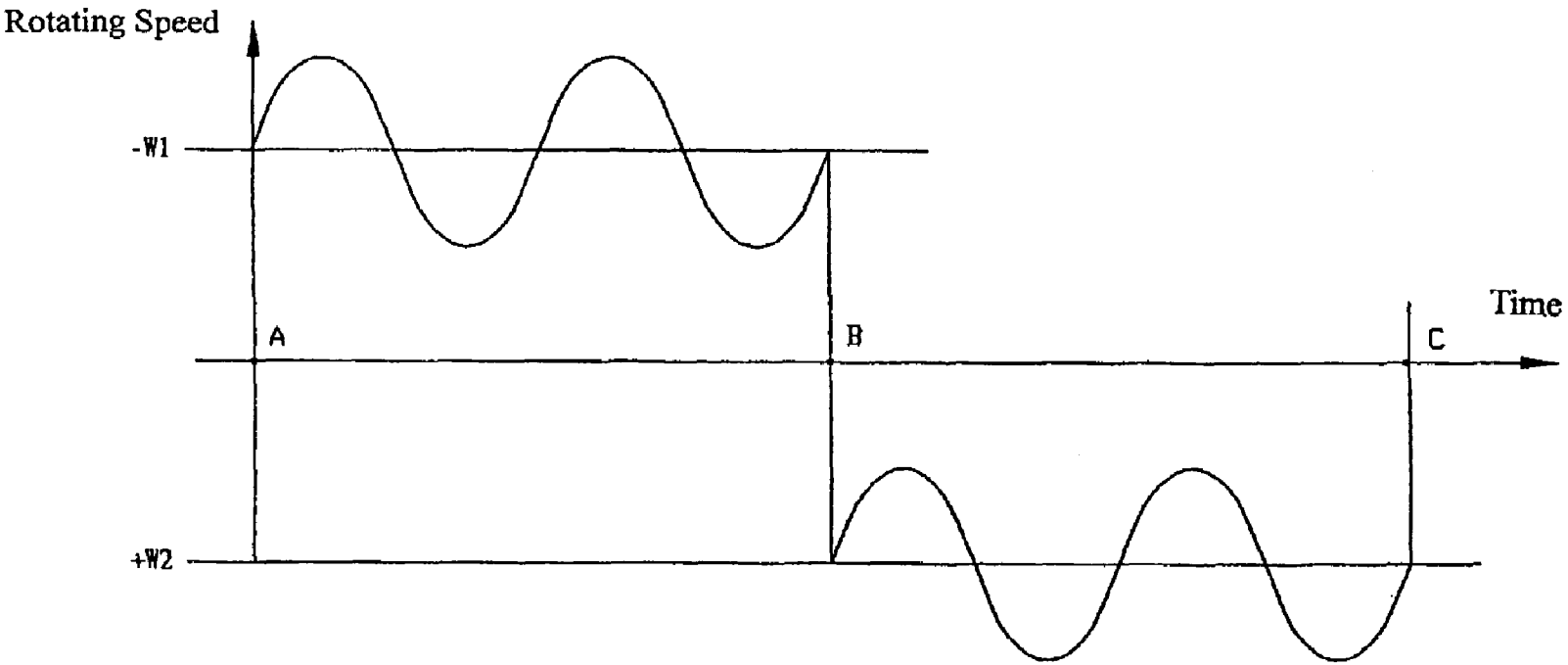
FIG. 7 plots rotating speed versus time for the activating motor in its second operating mode.

Referring to FIG. 7, a second operating mode of the invention is illustrated. A vibration device (not shown) is provided and operates in cooperation with the motor 21. In a time period from point A to point B the motor 21 clockwise rotates in a low speed as indicated by W1 (i.e., the same as one described in FIG. 6) and the vibration device operates in a high vibration frequency to vibrate the bed unit 12. Further, in a next time period from point B to point C the motor 21 counterclockwise rotates in another low speed as indicated by W2 (i.e., the same as one described in FIG. 6) and the vibration device operates in a high vibration frequency to vibrate the bed unit 12. As a result of the time period combination, the flux is cut more effective. As an end, an accelerated blood circulation and enhanced massage effect to the body is carried out.

Figure 8:
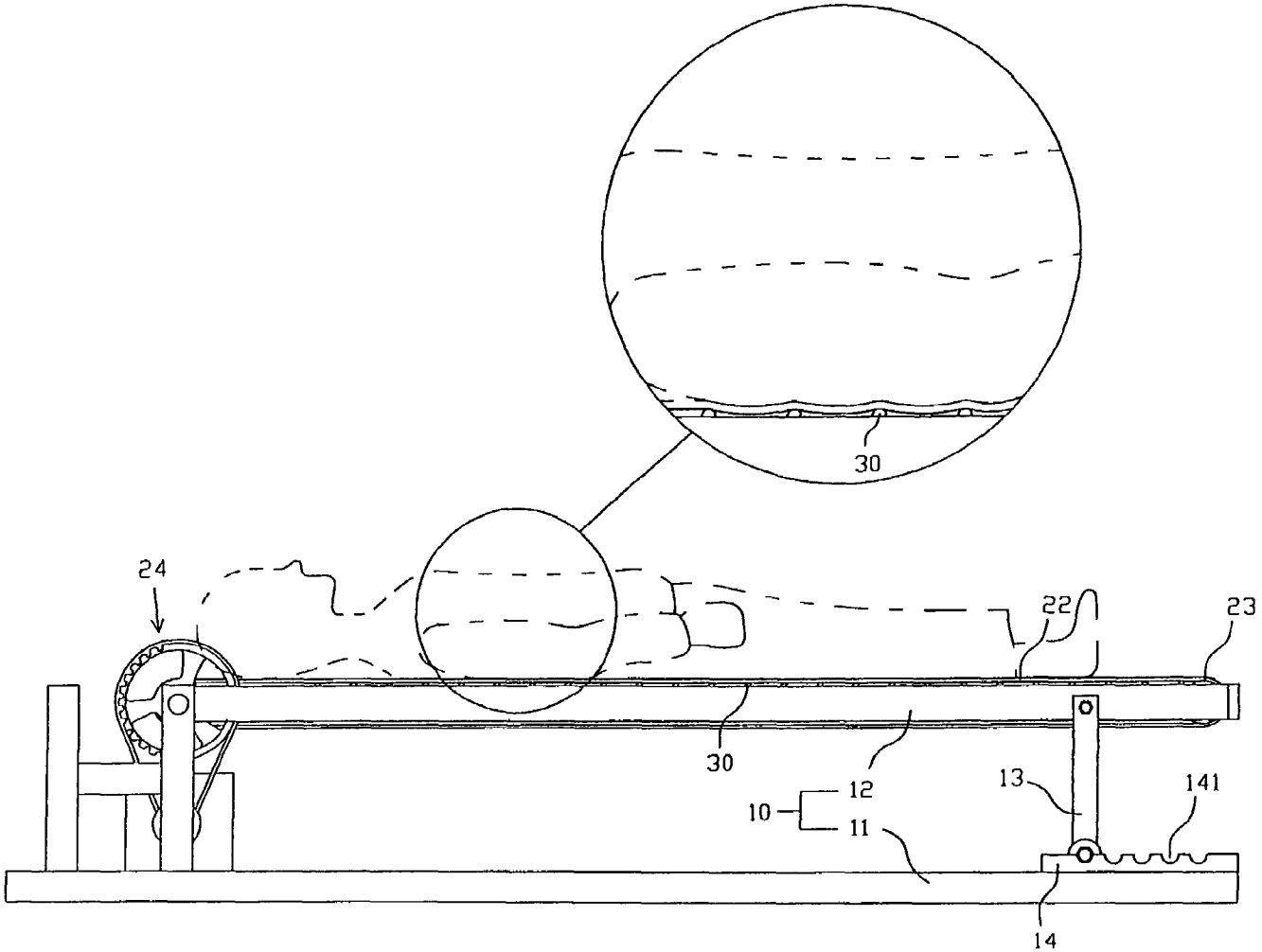
FIG. 8 is an environmental view of the bed with a person lying on an upper run of the transfer belt for being massaged.

Referring to FIG. 8, a person lies on the upper run of the transfer belt 22 with the back spaced from the magnets 30 by the transfer belt 22. Heat caused by friction between the conveying transfer belt 22 and the magnets 30 is conducted to the body. As a result, an effect similar to acupuncture is obtained. This is particularly beneficial to a weak person.

While the invention herein disclosed has been described by means of specific embodiments, numerous modifications and variations could be made thereto by those skilled in the art without departing from the scope and spirit of the invention set forth in the claims.

What is claimed is:

1. A health bed comprising:

a bed unit comprising a plurality of holes on its upper surface and a plurality of stone shaped permanent magnets each fastened respectively in said holes; and a drive assembly in a front end of the bed unit and comprising a motor, front and rear rollers driven by the motor, and an endless transfer belt rotatably driven by the rollers and covered on both surfaces of the bed unit;

wherein the transfer belt is driven by activating the motor, including changing a rotating speed of the motor per unit time, and changing a rotating direction of the motor according to a predetermined frequency per unit time, such that a person lying on the bed unit is moved back and forth by the transfer belt relative to a magnetic field from the magnets whereby a weak current flow is generated in the body of the person by magnetic induction while the back of the person is being massaged.

2. The health bed of claim 1, wherein each of the magnets has a portion either projecting from the upper surface of the bed unit or being flush with the upper surface of the bed unit.

3. The health bed of claim 2, wherein heat is generated by friction between the transfer belt and said magnets projecting from the upper surface of the bed unit, whereby a person lying on the transfer belt receives a heated massage.

4. The health bed of claim 1, wherein the bed unit further comprises two rear, lower toothed bars at both sides, and two rear folding rods each having an upper end pivotably connected to either side of the bed unit and a lower end adjustably connected to the toothed bar for adjusting height and inclination of the bed unit.

5. The health bed of claim 1, wherein the bed unit further comprises a plurality of transverse support members and a plurality of separate sections, a front one of the sections having its rear end pivotably connected to a front one of the support members, a rear one of the sections having its front end pivotably connected to a rear one of the support members, and one or more intermediate ones of sections each having its front and rear ends pivotably connected to one of the remaining support members such that the rear section is adapted to pivot toward the front section for folding the bed unit, and wherein the bed unit further comprises two pivotal extension boards each extended along side from either end of the support member at the rear section, and two press rollers each at an open end of the extension board for pressing a folded portion of the transfer belt.

* * * * *